United States Patent [19]

Calari

[11] Patent Number: 4,838,849

[45] Date of Patent: Jun. 13, 1989

[54] CHUCK DEVICE FOR HOLDING A CELL FOR THE CENTRIFUGATION OF BLOOD

[75] Inventor: Alessandro Calari, Mirandola, Italy

[73] Assignee: Dideco S.p.A., Mirandola, Italy

[21] Appl. No.: 153,176

[22] Filed: Feb. 8, 1988

[30] Foreign Application Priority Data

Feb. 10, 1987 [IT] Italy ..... 19331 A/87

[51] Int. Cl.[4] ..... B04B 15/00

[52] U.S. Cl. ..... 494/85; 279/106

[58] Field of Search ..... 494/16, 84, 85, 20; 366/208–218; 279/106, 35

[56] References Cited

U.S. PATENT DOCUMENTS 190,043 4/1877 Hurd ..... 279/106

1,131,696 3/1915 Hess ..... 279/106

*Primary Examiner*—Robert W. Jenkins

*Attorney, Agent, or Firm*—R. C. Turner; L. C. Akers; P. C. Richardson

[57] ABSTRACT

A chuck device comprises clamp elements having, at one end, an underlying tooth and a conical surface conjugated with the surface of a centrifugation cell. The clamp elements are uniformly distributed on the circumference of a plate including a surface upon which the bottom of the cell rests. The clamp elements are pivoted on the plate so as to be rotatable in radial planes, and can be locked in the closed position.

8 Claims, 2 Drawing Sheets

1
2
2a
3
3a
3b
3c
4
5
7
8
9
10
11b
12
13
14
14a
15
15a
16
16a

CHUCK DEVICE FOR HOLDING A CELL FOR THE CENTRIFUGATION OF BLOOD

BACKGROUND OF THE INVENTION

The present invention relates to a chuck device for holding or fastening thereon a cell for the centrifugation of blood, and the like.

It is known that the centrifugal separation of blood components such as plasma, red and white blood corpuscles and platelets is performed in cells essentially constituted by a rotating container and a stationary coupling to which are connected ducts for the inflow of the blood and the outflow of the separated component intended to be collected. The container comprises an external bell-shaped envelope, normally made of plastic and downwardly closed by a bottom welded thereto, which is caused to rotate by being fixed to a chuck connected to a rotating shaft.

Known chucks, however, have some disadvantageous characteristics, the most evident of which reside in the fact that they are provided with elements for gripping the cell having such a configuration as to exert exclusively radial thrusts. As a consequence of this, inner tensions are developed in the region proximate to the bottom of the container, and more precisely at the welding of the bottom to the bell-shaped envelope, where the maximum stress occurs as a combined effect of the centrifugal force and of the hydrodynamic thrust exerted by the flow of incoming blood. These inner tensions can be so strong as to possibly cause the breakage of the cell, with easily imaginable consequences.

What is described above with reference to the centrifugal separation of blood components is not limited to this field, and similar problems also occur in many other fields.

SUMMARY OF THE INVENTION

It is an object of the present invention to provide a chuck device for fastening thereon a cell for the centrifugation of blood and the like such as to firmly lock the cell, preventing it from being damaged even with very high rotational speeds.

It is another object of the invention to provide such a chuck wherein the gripping elements for the cell are easily operated.

These and other objects are achieved with a novel chuck device of the type described herein comprising a support member and a plurality of clamp or jaw members arranged around the axis of rotation of the device, with at least one of the jaw members being pivotally supported, for opening and closing, about a pivot axis transverse to said axis of rotation.

DETAILED DESCRIPTION OF THE INVENTION

Further characteristics and advantages of the invention will become apparent from the description of a preferred but not exclusive embodiment thereof, which is illustrated only by way of non-limitative example in the accompanying drawings, wherein.

Figure 1:
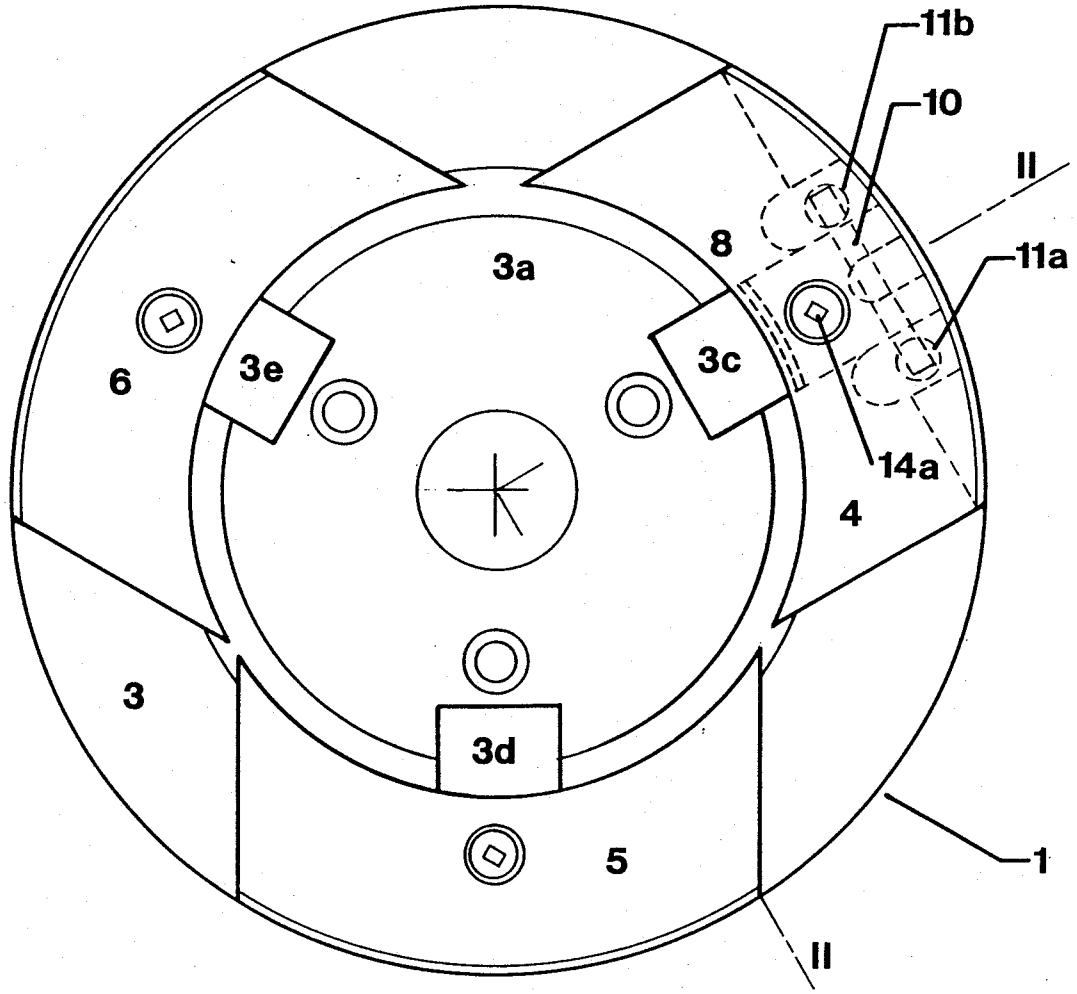
FIG. 1 is a top plan view of a chuck device of the invention with the jaw elements in the closed position and in the absence of a centrifugation cell.

With reference to the figures described above, the numeral 1 indicates generally a chuck device for fastening a cell for the centrifugation of blood materialized by the container body 2 thereof, which is intended to rest, in the locked position, with the cell bottom 2*a* on the surface 3*a* of a circular crown provided on a plate member 3.

The chuck device 1 comprises the plate member 3, preferably made of a metallic material such as an aluminum alloy and adapted to be rotated by a rotating shaft (not shown) coaxial with the plate 3 and fixed to the plate 3 by means of joints provided on the end of the shaft and screws inserted in holes 3*b*. The chuck also comprises clamp or jaw elements 4, 5, 6 uniformly distributed on the circumference of the plate 3 for fastening the cell container 2 thereon; these elements are made of a plastic material to reduce the amount of rotating mass, and have such a circumferential extension that the contact thereof with the cell container 2 occurs, in the manner described hereinafter, substantially continuously, i.e. smoothly, without jerks.

Preferably, said jaw elements 4, 5, 6 are identical, and only the one indicated at 4 will therefore be described in detail. Said jaw element 4 is provided, at one internally facing end, with a conical surface 7 which is intended to make contact and engage with the surface of the cell container 2 when the latter rests with its bottom on the circular crown 3*a*, the conical surface 7 being shaped according to the surface of the cell 2. For this purpose the conical surface 7 is recess-shaped near the plate member 3. The clamp element 4 is provided furthermore with a tooth 8 having a reduced circumferential extension limited to the central region of the surface 7; this tooth 8, the function of which is explained hereinafter, is adapted to be inserted, when the element 4 is in the closed position as indicated in FIG. 2, in a recess 3*c* provided on the crown 3*a* of the plate 3 to create a depression in a limited region of the circular crown surface 3*a* for allowing the bottom 2*a* of the cell to rest thereon.

In the same manner the teeth of the clamp or jaw elements 5 and 6, not shown in the drawings, are adapted to be inserted in the recesses 3*d* and 3*e*, respectively.

Figures 2, 3:
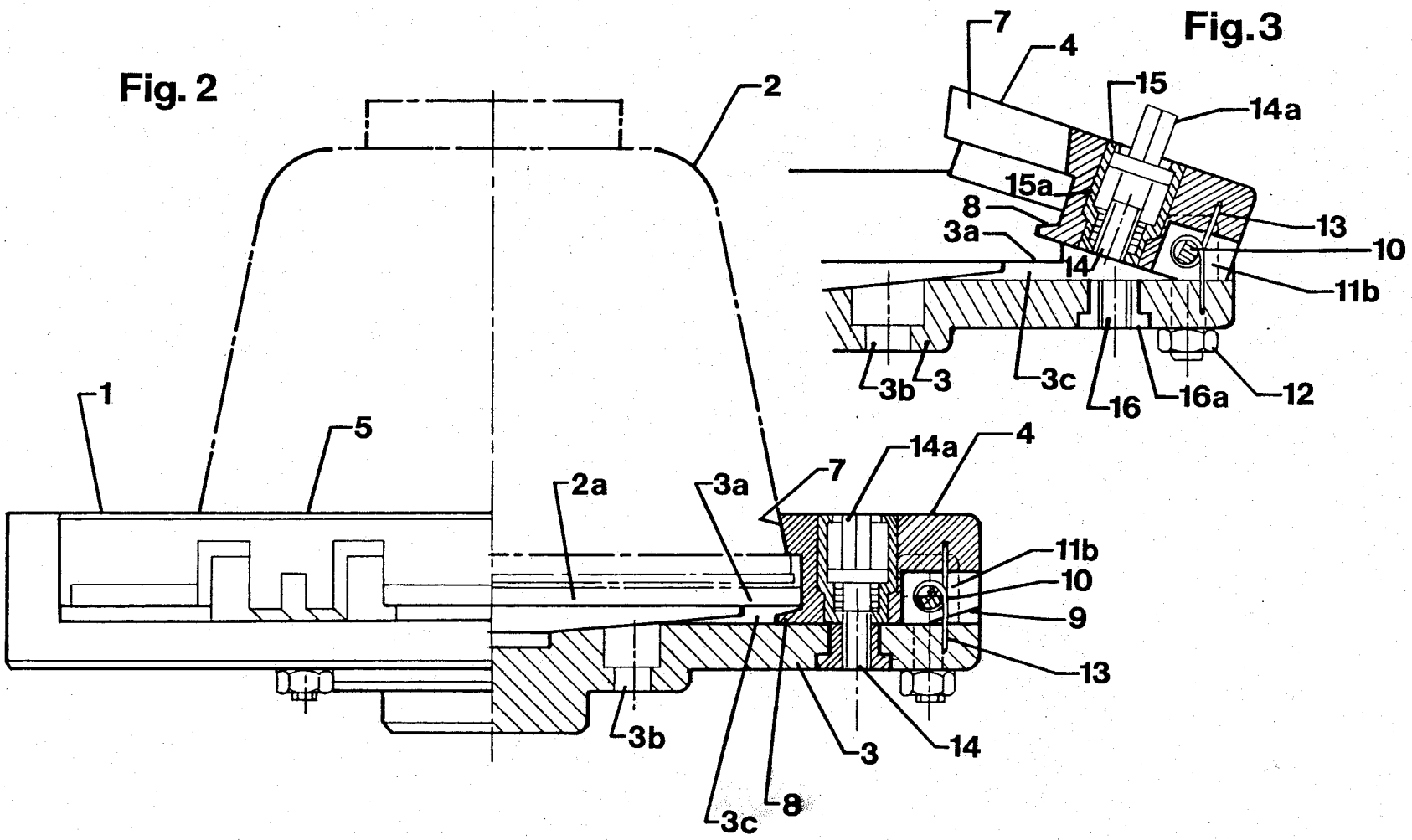
FIG. 2 is a view in a slightly enlarged scale, partially in section, taken along the broken line II—II in FIG. 1, of the chuck device supporting a cell shown in phantom lines.
FIG. 3 is a sectional view of the jaw element visible in FIG. 2 in the open position.

The jaw element 4 is pivoted with respect to the plate 3 so as to be rotatable in a radial plane between the open position shown in FIG. 3, determined by the resting of the tapered surface 9 thereof on the upper surface of the plate 3, and the closed position shown in FIG. 2. The element 4 is in fact associated with the pivot 10 supported by the studs 11*a* and 11*b* which are rigidly associated with the plate 3 by having a threaded stem thereof inserted in a hole of said plate, and subsequently tightened by a nut 12.

A helical spring 13 is coiled on the central part of the pivot 10 and has its ends in contact respectively with the plate 3 and with the element 4, and biases the clamp or jaw element 4 in the open position shown in FIG. 3.

The locking means, that keeps the clamp or jaw element 4 in the closed position, comprises a screw 14, housed in a bush 15 and having a square actuation stem 14*a*, which is adapted to engage with the female thread 16 provided in a bush 16*a* rigidly associated with the plate 3. By tightening the screw 14 a spring 15*a* is loaded. The spring 15*a* has the function of moving the screw 14 upwards, as soon as the latter is disengaged from the threads of the female thread 16 in the opening step, to the position shown in FIG. 3, thus achieving the double purpose of preventing any hindrance in the closure movement of the element 4, any possible jamming of the screw 14 on the plate 3 being prevented, and of having the stem 14*a* pop out from the upper surface of the element 4 so as to constitute a signal which makes evident for the operator that the screw 14 is not screwed in.

The operation of the chuck device 1 of the invention is extremely simple. With the clamp or jaw elements 4, 5, 6 open, that is to say in the position indicated for the element 4 in FIG. 3, a container cell 2 preferably is moved in the axial direction towards the chuck, and in the last steps of the approaching movement the bottom 2*a* of the cell gets in contact with the teeth 8 of elements 4, 5, 6 causing the lowering of said elements towards the closed position, overcoming the action of the springs 13.

In fact, the jaws or clamps 4, 5, 6 are arranged on a common circumference and are so designed and dimensioned that the internally-facing tips of the teeth 8 of the jaws 4, 5, 6 lie on a circumference the diameter of which is slightly smaller than the external diameter of the bottom 2*a* of the cell 2.

When the cell container 2 reaches the position in which the bottom 2*a* rests on the surface 3*a*, the elements 4, 5, 6 achieve the closure position depicted in FIG. 2, the respective conical surfaces being in contact with and mating with the external surface of the cell container 2. The teeth 8 have, in this condition, fully inserted themselves inside the recesses 3*c*, 3*d*, 3*e*, respectively, so as not to affect the optimum condition of resting of the cell bottom 2*a* on the surface 3*a*.

It will be understood that, according to a modified embodiment, one or even two of the jaw elements of simplified shape may be stationary, i.e. not swingable, and only one of the jaws swingable. In such a case, the cell container will be first inserted into the fixed jaw members in an inclined condition, and will then be swung to engage the swingable jaw and entrain it in its closing position.

The locking in closed position of the elements 4, 5, 6 is performed by an operator by actuating one after the other the screws 14 present on each thereof and the fastening of the cell container 2 which has been effected in this manner is such as to offer the greatest assurances since on said cell, besides the radial thrust, a thrust directed along the axis of rotation is also simultaneously determined, and these thrusts are applied in the region of maximum stress so as to also effectively collaborate to the resistance thereto.

The described invention is susceptible to numerous modifications and variations, all of which are within the scope of the inventive concept.

For example, the mutual position of the jaw members 4, 5, 6 may be made adjustable to change the diameter of the circumference on which the jaw members lie. This may be done for instance by either providing the jaw members with a composite structure and rendering the grasping part of the jaw member radially expandable or retractable or by providing the plate member 3 with a composite structure which may be radially expanded or retracted to position the unit including the studs 11 and the bush 16*a* nearer to or further from the axis of rotation of the chuck.

Furthermore, the pivot 10 may be arranged upwardly offset with respect to the circular crown 3*a*, so that the radially directed forces passing underneath the pivot 10 and generated during the clamping action may create a rotating moment in the closing direction of the jaw members to press the body 2 against the plate 3 even in lieu of the locking means.

Moreover, all the details may be replaced with other technically equivalent elements. In the practical embodiments of the invention, the materials employed, as well as the shapes and dimensions, may be any suitable ones.

I claim:

1. A chuck device for holding a body, in particular a cell for the centrifugation of blood and the like, comprising a rotary support member defining an axis of rotation of the chuck device and a plurality of clamp members supported on said support member, and said clamp members being arranged around said axis of rotation for holding said body therebetween, and with at least one of said clamp members being supported on said support member pivotally about a pivot axis extending transversely to said axis of rotation to allow swinging of said clamp member from a closed position into an open position, and vice versa, wherein each of said clamp members has an inwardly-facing surface portion for mating engagement with said body, said surface portion being conical and divergent in the direction towards said support member, and has a recessed portion between said surface portion and said support member.

2. A chuck device of claim 1 wherein said clamp members are made of plastic.

3. A chuck device of claim 1 wherein each of said clamp members is provided with a tooth formation projecting radially/inwardly from the lower end thereof.

4. A chuck device of claim 3 wherein said clamp members are at least three in number and are generally arranged along a generic circumference concentric with said axis of rotation, said inwardly-facing engaging surface portion has an upper edge thereof lying on a first circumference having a smaller diameter than a second circumference on which a lower edge of said engaging surface portion lies, and said tooth formation has an inner tip lying on a third circumference the diameter of which is smaller than the diameter of said second circumference.

5. A chuck device of claim 1 wherein said support member has, on the side on which said clamp members are supported, an annular crown formation with an annular upper surface thereon for allowing the bottom of the body being held by the chuck device to rest thereon, and said crown formation is provided with a depression for receiving therein a tooth formation projecting radially/inwardly from the lower end of said pivotally-supported clamp member.

6. A chuck device of claim 5 wherein said pivot axis is defined by a pivot supported on studs and is upwardly offset with respect to said crown formation to allow radial forces directed below said pivot axis to press said body against said crown formation.

7. A chuck device of claim 1 wherein said pivotally-supported clamp member includes locking means for selectively locking said member in the closed position thereof and thereby pressing said member against said support member.

8. A chuck device of claim 7 wherein said locking means comprises a screw axially slidable within limits within a hole-defining means provided in said clamp member and cooperating with female screw thread means provided in said support member, with spring means being provided for urging said screw upwards to allow the upper end of said screw to pop out of said hole-defining means when disengaged from female screw thread means.

* * * * *